US010045582B2

(12) United States Patent
Grandin et al.

(10) Patent No.: US 10,045,582 B2
(45) Date of Patent: Aug. 14, 2018

(54) LOCKING DEVICE FOR A SPORTS FOOTWEAR AND SPORTS FOOTWEAR PROVIDED WITH SUCH LOCKING DEVICE

(71) Applicant: Tecnica Group S.P.A., Giavera Del Montello (TV) (IT)

(72) Inventors: Giorgio Grandin, Giavera Del Montello (IT); Dino Maccari, Giavera Del Montello (IT)

(73) Assignee: TECNICA GROUP S.P.A., Giavera Del Montello (TV) (IT)

( * ) Notice: Subject to any disclaimer, the term of this patent is extended or adjusted under 35 U.S.C. 154(b) by 41 days.

(21) Appl. No.: 15/166,568

(22) Filed: May 27, 2016

(65) Prior Publication Data

US 2016/0345658 A1 Dec. 1, 2016

(30) Foreign Application Priority Data

May 28, 2015 (IT) ..... 102015000018986

(51) Int. Cl.
*A43B 5/04* (2006.01)
*A43C 11/00* (2006.01)
(Continued)

(52) U.S. Cl.
CPC ..... *A43B 5/047* (2013.01); *A43B 5/0452* (2013.01); *A43B 5/0456* (2013.01);
(Continued)

(58) Field of Classification Search
CPC ..... A43B 5/0452; A43B 5/0456; A43B 5/047; A43B 5/0474; A43C 11/142; A43C 11/1453
(Continued)

(56) References Cited

U.S. PATENT DOCUMENTS 4,265,034 A * 5/1981 Salomon ..... A43B 5/04 36/105
4,601,117 A * 7/1986 Leonardi ..... A43B 5/0452 36/118.7
(Continued)

FOREIGN PATENT DOCUMENTS

EP 0664969 A2 8/1995
EP 1332689 A1 8/2003
(Continued)

OTHER PUBLICATIONS

Italian Search Report and Written Opinion issued in connection with counterpart co-pending Italian Patent Application filed on May 28, 2015.

*Primary Examiner* — Marie Bays
(74) *Attorney, Agent, or Firm* — Howson & Howson LLP

(57) ABSTRACT

A locking device for sports footwear is adapted to lock two mutually hinged portions of sports footwear or to release them from each other. The locking device may be used in a ski boot for locking or releasing the shell and cuff relative to each other. The locking device comprises a male member and a female member, which members comprise respective engaging elements adapted to cooperate with each other, and actuating elements for moving the members from a configuration in which the male member is disengaged from the female member to a configuration in which the male member is engaged with the female member. The engaging elements of the male member and/or the engaging elements of the female member have a tapered or conical shape, whereby it is possible to make a coupling without clearance between the male member and the female member when the members are engaged.

4 Claims, 3 Drawing Sheets

(51) Int. Cl.
*A43C 11/12* (2006.01)
*A43C 11/14* (2006.01)

(52) U.S. Cl.
CPC ..... *A43B 5/0474* (2013.01); *A43C 11/008* (2013.01); *A43C 11/12* (2013.01); *A43C 11/142* (2013.01)

(58) Field of Classification Search
USPC ..... 36/118.4, 118.7
See application file for complete search history.

(56) References Cited

U.S. PATENT DOCUMENTS 4,601,118 A * 7/1986 Zanatta ..... A43B 5/0466 36/118.2
4,622,765 A * 11/1986 Baratto ..... A43B 5/0452 36/118.7
4,733,484 A * 3/1988 Delery ..... A43B 5/0458 36/117.9
4,934,075 A * 6/1990 Benetti ..... A43B 5/0452 36/118.7
5,065,533 A * 11/1991 Paris ..... A43B 5/0474 36/118.1
5,136,794 A * 8/1992 Stampacchia ..... A43B 5/0474 36/118.7
5,265,352 A * 11/1993 Chemello ..... A43B 5/0474 36/118.7
5,283,964 A * 2/1994 Chemello ..... A43B 5/0474 36/118.7
5,341,584 A * 8/1994 Paris ..... A43B 5/0433 36/117.1
5,363,572 A * 11/1994 Marega ..... A43B 5/0466 36/118.2
5,457,899 A * 10/1995 Chemello ..... A43B 5/0474 36/118.7
6,298,584 B1 10/2001 Bauvois
6,622,402 B2 * 9/2003 Challande ..... A43B 5/0474 36/117.1
9,241,532 B2 * 1/2016 Haugen ..... A43B 5/0456
2005/0016027 A1 * 1/2005 Trinkaus ..... A43B 3/0005 36/115
2014/0013629 A1 * 1/2014 Haugen ..... A43B 5/0456 36/117.1
2015/0033586 A1 * 2/2015 Parisotto ..... A43B 5/0456 36/117.1

FOREIGN PATENT DOCUMENTS

JP H11-099464 A 4/1999
WO 2012/165591 A1 12/2012

* cited by examiner

LOCKING DEVICE FOR A SPORTS FOOTWEAR AND SPORTS FOOTWEAR PROVIDED WITH SUCH LOCKING DEVICE

BACKGROUND

The present invention relates to a locking device for a sports footwear, the locking device being adapted to lock two mutually hinged portions of the footwear relative to each other or release them from each other. More particularly, the present invention relates to a locking device for a sports footwear comprising a shell and a cuff that are hinged to each other, the locking device being adapted to lock the shell and cuff to each other or release them from each other.

The present invention finds application, for example, in the field of ski boots, both ski-touring boots and alpine ski boots. The present invention further relates to a sports footwear provided with the aforesaid locking device.

Sports footwear comprising a substantially soft inner element and a substantially rigid outer element are known. A typical example of this kind of footwear consists of ski boots, which have a substantially soft inner liner and a substantially rigid outer shell.

According to prior art, in the ski boot a cuff adapted to receive the user's ankle and lower part of the leg is coupled to the substantially rigid shell configured for receiving the user's foot. The cuff is generally hinged to the shell at the malleolar region, so as to allow, if desired, a rotation of the cuff relative to the shell. More particularly, when the user is skiing, it is preferable that the cuff is locked relative to the shell, so that movements, even minimal ones, of the user's leg are rigidly transmitted to the ski boot and from this to the ski. Instead, when the user is not wearing his/her skis and has to walk, it is preferable that the cuff is free to rotate relative to the shell, so as to make walking more comfortable.

Devices that can move from a first configuration in which rotation of the cuff relative to the shell is locked (configuration suitable for skiing) to a second configuration in which the cuff can rotate relative to the shell (configuration suitable for walking) are known from prior art. More particularly, in the case of ski-touring boots, in the first configuration the locking devices of the aforementioned type are configured so as to lock the relative movement of the cuff relative to the shell in both directions, whereas in the case of alpine ski boots, such boots are configured so as to lock the relative movement of the cuff relative to the shell only in one direction (i.e. the direction in which the cuff rotates towards the shell).

Such locking devices generally provide for a male member connected to the cuff and a female member connected to the shell, or vice versa, at least one of the members being arranged movably. The male member can be brought, for instance by means of a rotational or translational movement, to engage into the female member or disengage therefrom, or vice versa; when the male and female members are mutually engaged, the rotation between shell and cuff is prevented, whereas when the male and female members are mutually disengaged the cuff is free to rotate relative to the shell. Actuating elements are provided for actuating the rotational or translational movement of the male member (or of the female member) for moving from a configuration to the other one.

In the most simple and widespread embodiment, the male member of the locking device comprises a body having one or more teeth and the female member comprises a body in which one or more corresponding seats for the teeth of the male member are provided.

The coupling between the male member and the female member necessarily requires some clearance between the two members, due on one part to the manufacturing tolerances and on the other part to the need of providing for a theoretical clearance intended to compensate for the rotational adaptation between shell and cuff. When a transverse translational adaptation between shell and cuff ("canting" adjustment) is to be taken into account, this clearance is very high.

The clearance between the aforesaid two members increases progressively during the use of the ski boot due to wear, with a speed that depends on the materials that are used and to the applied loads. The presence of such clearance between the two members of the locking device is a remarkable drawback for the user, because even in the locked position (configuration suitable for skiing) some relative movement between shell and cuff of the ski boot still exists.

This drawback is particularly detrimental when taking into account the fact that the locking device is positioned in the lower part of the cuff, in the vicinity of the hinge point of the cuff to the hull; a clearance, even a small one, in such a position results in a perceivable rotation of the cuff in its upper part; for example a clearance of 0.5 mm between the members of the locking device can result in a relative movement of the top of the cuff up to about 4-5 mm, distinctly and unpleasantly perceivable by the skier.

The object of the present invention is to solve the above mentioned problem by providing a locking device able to effectively lock the cuff and the shell of a ski boot relative to one another. This and other objects are achieved with the locking device and the sports footwear as claimed in the appended claims.

SUMMARY

The locking device according to the invention comprises a male member and a female member, the members comprising respective engaging elements which are adapted to cooperate with each other and at least one of which is arranged movably, and actuating elements for moving the members from a configuration in which the male member is engaged in the female member to a configuration in which the male member is disengaged from the female member, and vice versa.

According to the invention, owing to the fact that the engaging elements of the male member and/or of the female member of the locking device have a tapered or conical shape, it is possible to obtain a firm, clearance-free coupling between the male member and the female member when the male member is brought into engagement with the female member.

Indeed, owing to the tapered or conical shape, when the actuating members are acted upon for moving the locking device from the configuration in which the male and female members are disengaged from each other to the position in which the members are engaged with each other, the corresponding translational or rotational movement will continue until the male member becomes wedged into the female member.

By providing a coupling of this type, even after wear-related deformations of the male member and/or female member of the locking device any clearance can be compensated for and a clearance-free coupling can be ensured.

The making of a tapered or conical coupling between the male member and the female member of the locking device involves that the friction forces between these two members are not oriented in a purely vertical direction, but they rather include a horizontal component, and more particularly a component oriented in a horizontal direction and directed outwards, which would tend to cause loss of engagement between the male member and the female member of the locking device.

For this reason, the actuating elements of the locking device will have to be configured so as to provide for elements for biasing the male member against the female member when the members are mutually engaged, so as to overcome the aforesaid horizontally oriented component of the force, thus preventing inadvertent disengagement of the two members of the locking device.

At the same time, the so configured actuating members further ensure that the male member penetrates as much as possible into the female member, thus ensuring absence of clearances.

In an embodiment of the invention, the actuating members comprise a lever which can assume two different stable positions and a wedge-shaped element connected to the lever with interposition of a spring or similar elastic element, and the wedge-shaped element is connected to the movable member of the locking device: by switching the lever of the actuating elements from a position to the other position it is possible to move the wedge-shaped element from a retracted position in which the male and female members of the locking device are disengaged from each other to an advanced position in which the wedge-shaped element progressively pushes the movable member against the other member of the locking device and firmly holds the male and female members of the locking device in a configuration of maximum engagement, opposing any stresses tending to loosen the engagement between these members and create clearances.

In an alternative embodiment of the invention, the actuating elements comprise a screw which is actuatable by the user from outside the footwear and is screwed in a threaded bushing fixed to the footwear and, while being screwed, pushes the male and female members each against each other, thus eliminating possible existing clearances and opposing any stresses tending to loosen the engagement between the members.

BRIEF DESCRIPTION OF THE DRAWINGS

Further features and advantages of the invention will become more apparent from the following detailed description of some preferred embodiments of the invention, given by way of non-limiting example with reference to the annexed drawings, in which.

DETAILED DESCRIPTION

The preferred embodiments of the invention described below refer to the application of the invention to a ski boot comprising a shell and a cuff hinged to each other. Such embodiments are not to be considered as limiting in any way the scope of the invention and the invention can be applied to any sports footwear comprising two mutually hinged portions in which it is deemed necessary or convenient to provide that—depending on the user's needs—the footwear can assume a configuration in which the portions are movable relative to each other or a configuration in which the portions are locked relative to each other.

Figure 1:
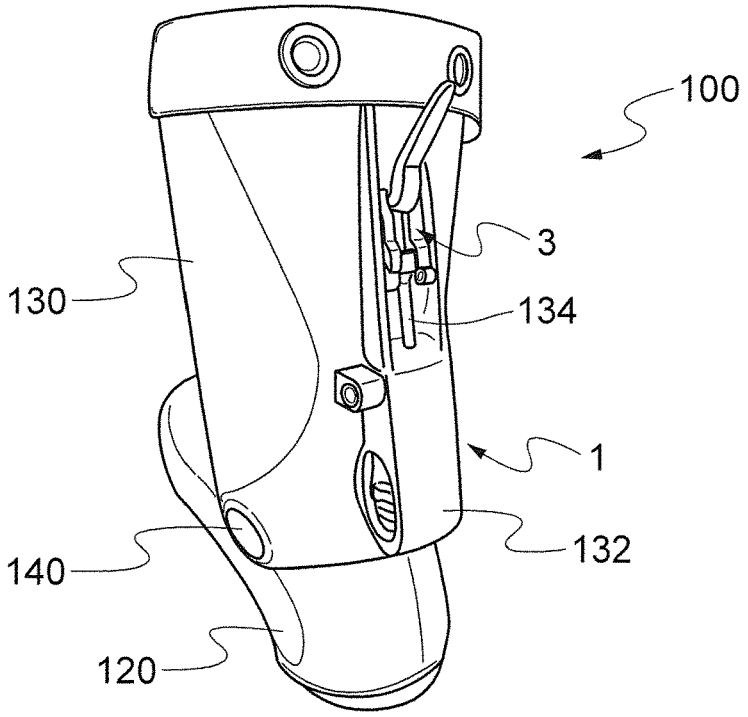
FIG. 1 schematically shows a sports footwear, more particularly a ski boot, incorporating a locking device according to a first embodiment of the invention.

Referring to FIG. 1, there is schematically illustrated a ski boot 100. The ski boot comprises an inner element or liner made of a substantially soft material (not visible in FIG. 1) and an outer shell 120 made of a substantially rigid material, configured for receiving the user's foot. In addition, the ski boot 100 comprises a cuff 130 adapted to receive the user's ankle and lower part of the leg. The cuff 130 partially overlaps the shell 120 and is hinged thereto by means of a pair of pins 140 arranged on the opposite sides of the ski boots and located substantially at the user's malleolar region.

As anticipated above, when the user is skiing, it is desired that any rotation of the cuff 130 relative to the shell 120 is prevented; on the contrary, when the user has to walk some way it is preferable that the cuff 130 is free to rotate relative to the shell 120. To this aim, the ski boot 100 is provided with a locking device 1 that can selectively lock the possibility of the cuff 130 to rotate relative to the shell 120.

Such locking device 1, which will be described in detail below, is arranged in the lower portion of the cuff 130, in the area overlapping the shell 120, preferably in the rear portion of the ski boot 100. Correspondingly, the cuff 130 in its lower portion comprises a portion shaped so as to form a housing 132 for receiving the locking device, except for the actuating elements 3 of the locking device, which are located—at least partially—outside the housing 132, so that they can be accessible by the user for moving the locking device 1 from the configuration in which rotation of the cuff 130 relative to the shell 120 is prevented to the configuration in which such rotation is allowed, and vice versa.

The housing 132 is provided with an opening 134 allowing passage of connecting elements for connecting the actuating elements 3 of the locking device 1 to that member of the locking device that is actuated by them.

Figure 2A:
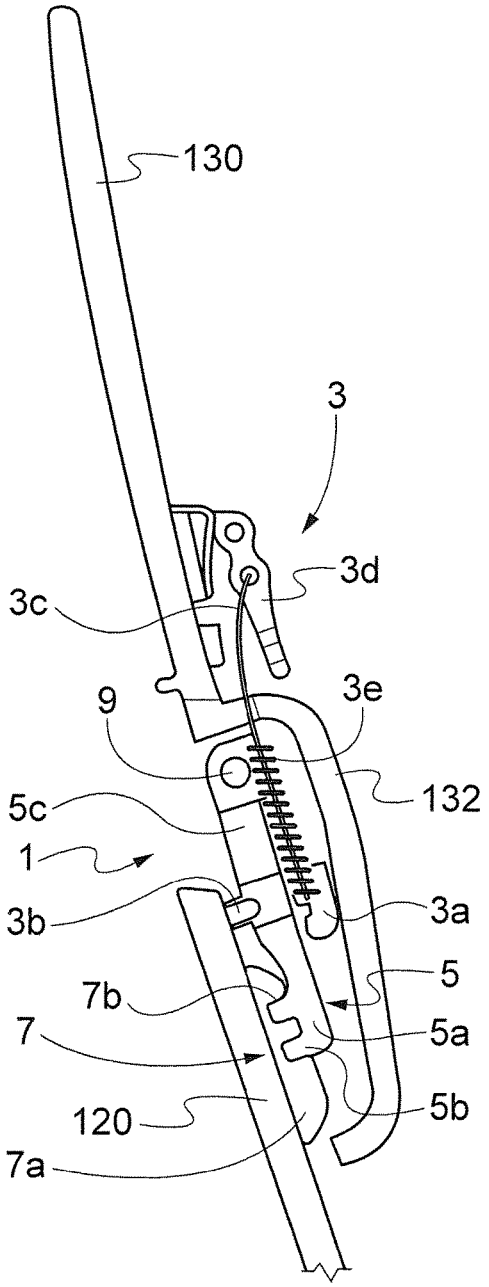
FIG. 2*a* schematically shows a cross-section of the locking device according to the first embodiment of the invention, illustrated in a first configuration.
Figure 2B:
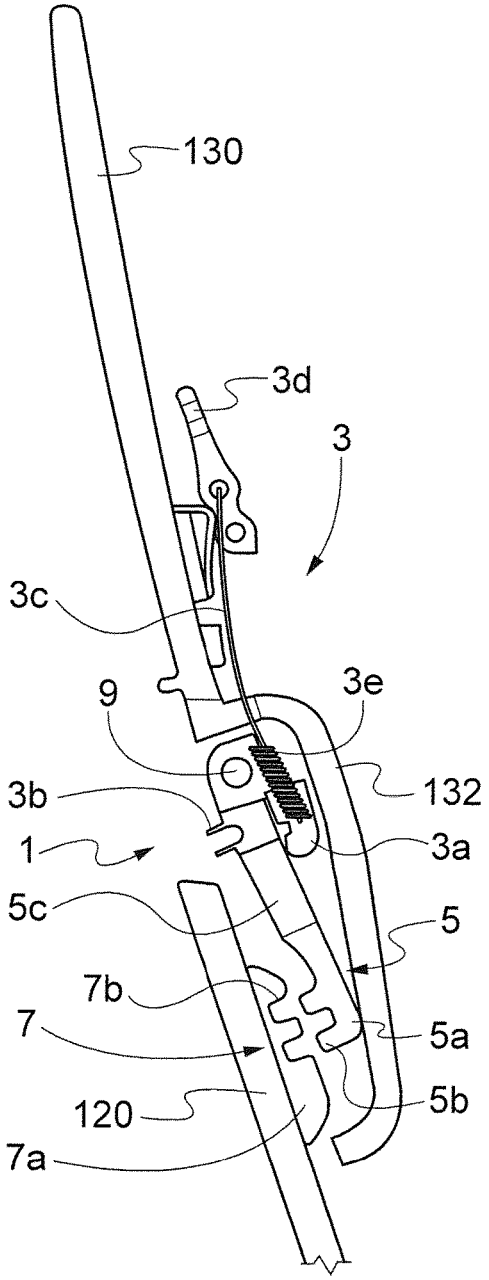
FIG. 2*b* schematically shows a cross-section of the locking device of FIG. 2*a,* illustrated in a second configuration.

The locking device 1 according to a preferred embodiment of the invention is illustrated in detail in FIGS. 2*a* and 2*b.* The locking device 1 comprises a male member 5, consisting of a body 5*a* having a plurality of teeth 5*b,* and a female member 7, consisting of a body 7*a* in which corresponding seats 7*b* for the teeth 5*b* of the male member 5 are provided.

At least one member of the locking device is movable, whereas the other one is preferably stationary. In the illustrated embodiment, the female member 7 is fixed to the shell 120 of the ski boot 100. The male member 5, instead, is mounted so as to be movable, more particularly rotatable, on the cuff 130 of the ski boot 100 by means of a hinge pivot 9.

The male member 5 is connected to the actuating elements 3 and is actuated by them for moving from a first configuration in which the teeth 5*b* of the male member 5 are engaged in the seats 7*b* of the female member 7 (FIG. 2*a*) to a second configuration in which the teeth 5*b* of the male member are disengaged from the seats 7*b* of the female member 7 (FIG. 2*b*): in the aforesaid first configuration (FIG. 2*a*), owing to the engagement between the male and female members 5, 7 of the locking device, any rotation between shell and cuff is prevented; on the contrary, in the second configuration (FIG. 2*b*) the relative rotation between shell and cuff is not prevented by the locking device 1.

According to the invention, the engaging elements of the male member 5 and/or of the female member 7 are tapered or conical. More particularly, in the illustrated embodiment the teeth 5*b* of the male member 5 are tapered and the seats 7*b* of the female member 7 are tapered correspondingly. In this way it is possible to eliminate clearances between the engaging elements 5*b*, 7*b* of the male and female members 5, 7 of the locking device and—correspondingly—any minimum relative movement between the shell and cuff of the ski boot 100 when the locking device is in its first configuration (FIG. 2*a*).

In this embodiment of the invention, the actuating elements comprise a wedge-shaped element 3*a* which is interposed between the male member 5 of the locking device 1 and the inner wall of the housing 132 provided in the cuff 130 and is movably—more particularly slidably—connected to the male member 5. For this purpose, a slot 5*c* is formed in the male member 5 and the wedge-shaped element 3*a* is attached to a slider 3*b* mounted so as to be slidable in the slot 5*c*.

The wedge-shaped element 3*a* is further connected, by means of a transmission cable 3*c*, to an actuating lever 3*d* with interposition of a spring 3*e* or similar elastic element, the actuating lever being capable of assuming two different stable positions shown in FIGS. 2*a* and 2*b*, respectively.

When the actuating lever 3*d* is in the position shown in FIG. 2*a*, the wedge-shaped element 3*a* is in an advanced position, with its slider 3*b* at the distal end of the slot 5*c* of the male member 5. In this configuration, the wedge-shaped element is wedged between the inner wall of the cuff 130 and the body 5*a* of the male member 5, so as to push the male member 5 against the female member 7 and to make the teeth 5*b* of the male member 5 penetrate into the seats 7*b* of the female member 7 until any clearance is eliminated.

In this configuration the locking device 1 prevents relative rotation of the cuff 130 relative to the shell 120. In addition, the wedge-shaped element 3*a* opposes any horizontally directed force which would tend to loosen the engagement between the male and female members 5, 7 and create clearances.

By overcoming the resistance of the spring 3*e*, the actuating lever can be brought to the position shown in FIG. 2*b*. In this configuration, the wedge-shaped element 3*a* is in a retracted position, with its slider 3*b* at the proximal end of the slot 5*c* of the male member 5 and the male member 5 is correspondingly rotated around the pin 9 so that the teeth 5*b* of the male member 5 are disengaged from the seats 7*b* of the female member 7. In this configuration, the locking device 1 does not prevent relative rotation of the cuff 130 relative to the shell 120.

By rotating again the actuating lever 3*d*, it is possible to make the slider 3*b* slide within the slot 5*c* to the configuration of FIG. 2*a* and simultaneously cause movement of the wedge-shaped element 3*a*, which—by wedging itself between the inner wall of the housing 132 of the cuff 130 and the male member 5 of the locking device—progressively pushes the male member into engagement with the female member 7 of the locking device; the cuff 130 is thus locked again relative to the shell 120.

Figure 3:
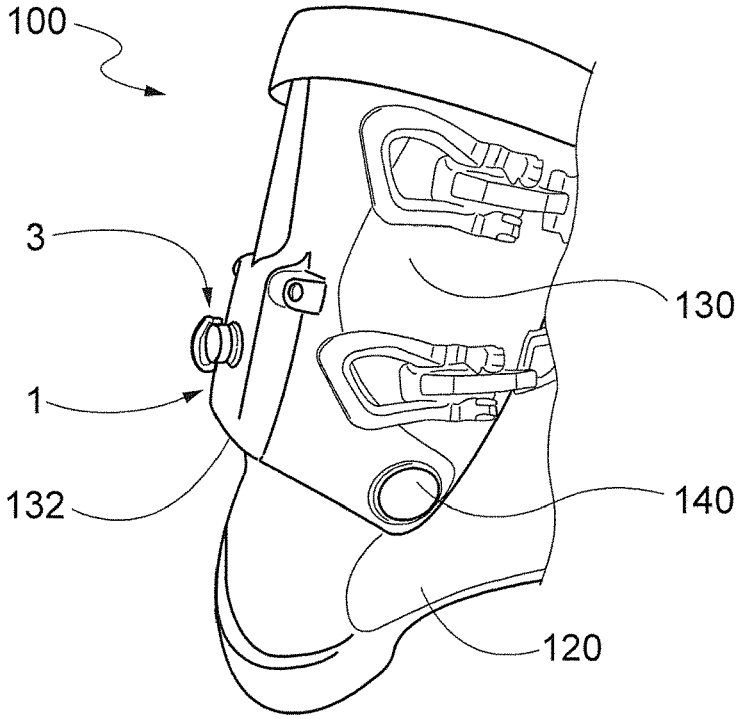
FIG. 3 schematically shows a sports footwear, more particularly a ski boot, incorporating a locking device according to a second embodiment of the invention.
Figure 4:
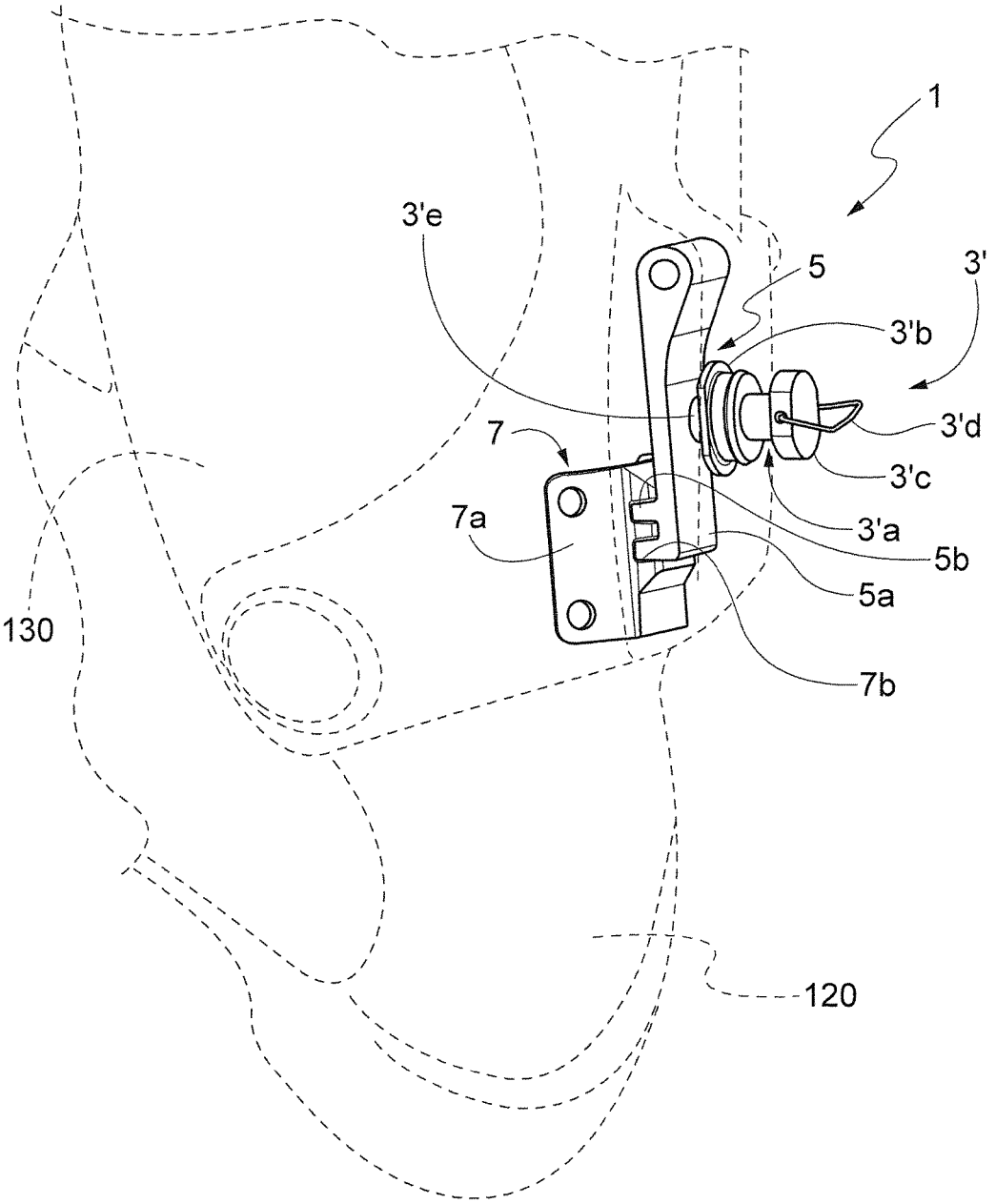
FIG. 4 schematically shows a perspective view of the locking device according to the second embodiment of the invention.

Turning to FIGS. 3 and 4, there is schematically illustrated the locking device 1 according to a second embodiment of the invention. The embodiment differs from the first embodiment described above in the structure of the actuating elements 3'.

In this embodiment, too, the locking device 1 comprises a male member 5, consisting of a body 5*a* having a plurality of teeth 5*b*, and a female member 7, consisting of a body 7*a* in which corresponding seats 7*b* for the teeth 5*b* of the male member 5 are provided. The female member 7 is configured so as to be fixed to the shell 120 of the ski boot 100, whereas the male member 5 is configured so as to be movably, more particularly, rotatably, mounted on the cuff 130 of the ski boot, which cuff 130 is hinged to the shell 120 by means of the pins 140 and—in its lower portion in which it overlaps the shell 120—is shaped so as to define a housing 132 for receiving the locking device 1.

The teeth 5*b* of the male member 5 are tapered and the seats 7*b* of the female member 7 are tapered correspondingly, so as to ensure absence of clearances when the male member is brought into engagement with the female member.

In this second embodiment, the actuating elements 3' comprise a screw 3'*a* which is screwed in a bushing 3'*b* fixed to the cuff 130 of the ski boot. The screw 3'*a* is arranged so that its head 3'*c* —possibly provided with a handle 3'*d* for facilitating rotation thereof—projects outside the cuff 130 so that it can be actuated by the user and its shaft 3'*e* penetrates through the cuff 130 into the housing 132 and comes into abutment against the male member 5 of the locking device.

By screwing the screw 3'*a*, it is possible to make it penetrate into the housing 132, whereby its shaft 3'*e* pushes the male member 5 against the female member 7 and make the teeth 5*b* of the male member penetrate into the seats 7*b* of the female member until any clearance is fully eliminated.

During use, the screw 3'*a* with its shaft 3'*e* opposes any horizontally oriented force directed outwards which would tend to loosen the engagement between the male and female members 5, 7 of the locking device.

It is clear from the above description that the invention achieves the objects set forth above by providing a locking device capable of locking two mutually hinged portions of a sports footwear relative to each other in an effective and clearance-free manner.

It is further evident that the embodiments described above in detail are in no way to be intended as limiting and that several modifications and variations within the reach of those skilled in the art may be made without departing from the scope of protection defined by the appended claims.

More particularly, contrary to what has been described with reference to the above illustrated embodiments, it is possible to provide a locking device in which the male member is stationary and the female member is movable and actuated by the actuating elements. More generally, the number, the type, the structure and the operation of the engaging elements of the male member and of the female member, of the actuating elements for moving the members from a configuration to the other one, and of the elements for pushing the male member against the female member when the members are engaged with each other can be chosen from time to time by the person skilled in the art on the basis of his/her knowledge and preferences, without departing from the scope of the invention as defined in the appended claims.

In addition, the sports footwear according to the invention may be equipped with an additional locking device (not provided for nor illustrated in the embodiments described above) capable of locking the two footwear portions relative to each to other permanently and independently from the locking device according to the invention. Such an additional locking device would therefore be a sort of "by-pass" of the locking device according to the invention and on one part it would allow to lock the two footwear portions even more firmly and without clearance and on the other part it would ensure the user that no accidental, undesired relative movement of the two footwear portions can occur during sports practice. The additional locking device can be, for instance, manually actuated and comprise a screw-nut system or similar system.

Finally, while the invention has been described with reference to a ski boot, it will be understood that it is also applicable to other types of footwear.

The invention claimed is:

1. A locking device for a sports footwear, the sports footwear comprising a shell and a cuff hinged to each other, wherein the locking device comprises a male member and a female member, which male member and female member are provided with respective engaging elements adapted to cooperate with each other and at least one of which members is arranged movably and is connected to actuating elements of the locking device, wherein one of the male member and female member of the locking device is stationarily mounted on the shell/the cuff of the sports footwear and the other one of the male member and female members of the locking device is movably mounted on the cuff/the shell of the sports footwear and is actuated by the actuating elements, the actuating elements being actuatable for moving the locking device from a first configuration in which the engaging elements of the male member are engaged with the engaging elements of the female member for preventing rotation of the cuff of the sports footwear relative to the shell of the sports footwear, to a second configuration in which the engaging elements of the male member are disengaged from the engaging elements of the female member so as to leave the cuff of the sports footwear free to rotate relative to the shell of the sports footwear, and vice versa, wherein the engaging elements of the male member and the engaging elements of the female member have a tapered or conical shape, whereby, when the actuating elements are actuated for moving the locking device from the second configuration to the first configuration, the engaging elements of the male member penetrate into the engaging elements of the female member until the male member becomes wedged into the female member so as to make a coupling without clearance when the engaging elements of the male member are wedged into the engaging elements of the female member, wherein the actuating elements comprise a wedge-shaped element movably connected to the male member/female member and an actuating lever connected to the wedge-shaped element by means of an interposed spring, wherein the actuating lever can move from a first to a second stable position for moving the actuating elements from the first to the second configuration, and vice versa, and wherein, when the actuating lever is in the first position, the wedge-shaped element pushes the male member and the female member against each other.

2. The locking device according to claim 1, wherein the engaging elements of the male member comprise one or more tapered teeth and wherein the engaging elements of the female member comprise one or more correspondingly tapered seats.

3. The locking device according to claim 1, wherein the male member/female member is provided with a slot, a slider movably mounted in the slot is provided and the wedge-shaped element is attached to the slider.

4. A sports footwear, of the kind comprising a shell and a cuff hinged to each other, comprising a locking device according to claim 1 for preventing/allowing the relative movement of the shell and the cuff relative to each other.

* * * * *